US005786644A

United States Patent [19]

Zaretsky

[11] Patent Number: 5,786,644

[45] Date of Patent: *Jul. 28, 1998

[54] TWO WIRE PIR OCCUPANCY SENSOR UTILIZING A RECHARGEABLE ENERGY STORAGE DEVICE

[75] Inventor: Albert Zaretsky, Brooklyn, N.Y.

[73] Assignee: Leviton Manufacturing Co., Inc., Little Neck, N.Y.

[ * ] Notice: The term of this patent shall not extend beyond the expiration date of Pat. No. 5,623,172.

[21] Appl. No.: 834,351

[22] Filed: Apr. 16, 1997

Related U.S. Application Data

[63] Continuation of Ser. No. 498,039, Jul. 3, 1995, Pat. No. 5,623,172.

[51] Int. Cl.[6] ..... H01H 35/00

[52] U.S. Cl. ..... 307/117; 307/48; 307/141.4; 340/565; 340/573; 250/221; 250/342; 361/160; 361/170; 361/173

[58] Field of Search ..... 307/117, 48, 141.4; 340/541, 565, 573; 250/221, 342; 361/160, 170, 173, 174

[56] References Cited

U.S. PATENT DOCUMENTS

| | | | |
|---|---|---|---|
| 4,321,592 | 3/1982 | Crandall et al. | 340/541 |
| 4,336,464 | 6/1982 | Weber . | |
| 4,661,720 | 4/1987 | Cameron et al. | 307/117 |
| 4,713,598 | 12/1987 | Smith | 323/245 |
| 4,797,657 | 1/1989 | Vozimmer et al. | 340/541 |
| 5,012,406 | 4/1991 | Martin | 364/200 |
| 5,623,172 | 4/1997 | Zaretsky | 307/117 |

*Primary Examiner*—William M. Shoop, Jr.
*Assistant Examiner*—Albert W. Paladini
*Attorney, Agent, or Firm*—Paul J. Sutton

[57] ABSTRACT

A two wire detection device includes a relay switch setable to a high and a low impedance state and electrically coupled between a first terminal of an AC source and a first leg of a load, a second leg of which is connected to a second terminal of the AC source. The device includes an energy storage device electrically coupled to the first terminal of the AC source and electrically connected to the first leg of the load. Charge control means interposed between the first terminal of the AC source and the energy storage device regulate the voltage across the energy storage device. A detection control device is electrically connected across the energy storage device and to the switching device for detecting the presence of a condition for monitoring and setting the state of the switching device based thereon such that power is available to the detection control device regardless of the state of the switch.

11 Claims, 1 Drawing Sheet

TWO WIRE PIR OCCUPANCY SENSOR UTILIZING A RECHARGEABLE ENERGY STORAGE DEVICE

This is a continuation of application Ser. No. 08/498,039 filed on Jul. 3, 1995, now U.S. Pat. No. 5,632,171 issued Apr. 22, 1997.

BACKGROUND OF THE INVENTION

A well known problem with conventional Passive Infra Red (PIR) occupancy circuits that use a relay output in a two wire system (i.e., no neutral) is that when the relay contact is closed, there is no power available to drive the control circuitry since the relay contacts short circuit the control circuitry. This problem is not exclusive to PIR occupancy circuits. In fact, any generic two wire electrical control device that switches power across a load when energized may display a similar problem, i.e., when the switched contact is in a low impedance state (the relay contacts are closed), the voltage across the device drops from a level approximate to that of the AC line voltage to almost zero. Thus, during the time the control device is on (energized), no power is available to drive the switching control circuitry.

One solution known in the art utilizes a technique whereby a small amount of current is purposely leaked to ground to drive control circuitry when power is switched across the load. The switching control circuitry, if designed so as to require a small amount of current to keep it operational (compared to the load circuitry), can derive the power it needs for operation from this ground leakage current. Underwriters Laboratory (UL) allows electrical devices 0.5 ma of leakage current wherefore such ground leakage current operation can be arranged. However, the 0.5 ma leakage current limitation makes designing using this technique difficult to implement.

For example, U.S. Pat. No. 4,713,598 to Smith discloses a power supply circuit for generating power from a switched AC source. The circuit includes a current transformer arranged in series with a controlled main conduction path (contact) of a relay switch disposed in the AC source/load main line. A series combination of a capacitor and a secondary winding of the transformer shunt the primary winding/relay contact series combination. When the relay switch is conductive, a comparatively small AC voltage appears across a secondary of the transformer which is rectified with a rectifying diode electrically connected to power an amplifier. A capacitor connected in shunt with the amplifier filters the DC generated by the diode. The amplifier is driven by a detection circuit (e.g., a passive infrared detector) which drives the relay switch. When the contact is in a non-conducting state (i.e., a high impedance state), no current flows in the transformer's primary. However, because little voltage is dropped across the load, almost the full potential of the AC source appears across the blocking capacitor/transformer secondary series combination. This open circuit potential is used to power the circuitry when the relay is non-conducting, i.e., ground leakage current.

U.S. Pat. No. 4,336,464 to Weber discloses a two-terminal timed electric switch for series connection with one side of a power-carrying AC circuit. An AC line terminal is electrically connected in series through a primary of a current transformer and a contact of a relay switch to a load. The load's other terminal is connected to the AC neutral. While the load is energized, the transformer's secondary provides power to a timer circuit. The circuit is energized when a momentary action start ("on") switch is temporarily closed (pressed) whereby the power is generated in the secondary for closing the relay contact. This momentary contact switch must be actuated before the Weber circuitry can be actuated. For example, were the timer circuit to be a PIR occupancy circuit, operation of the PIR circuitry would first require momentary closure of the momentary switch.

It would be beneficial, therefore, to realize a device for use in two-wire detector or sensor circuit which utilizes an energy source for operating the sensor independent of load activation or ground leakage current. The energy source could be independent from current operation, or dependent thereon, e.g., a charge storage device. It would also be beneficial to have a device for use in a two-wire sensor or detector circuit wherein a current transformer is utilized to indirectly supply the sensor or charge storage device during a time at which said load is powered by said AC source thereby minimizing the storage requirements of the charge storage device.

OBJECTS AND SUMMARY OF THE INVENTION

Accordingly, it is an object of the present invention to provide a two wire sensor, such as a passive infrared occupancy sensor, with means for storing electrical power to drive internal sensor control circuitry when source electrical power which drives both the sensor and the load is switched across the load.

It is another object of the present invention to provide a two-wire sensor with means for storing electrical power for driving sensor control circuitry when source electrical power which drives both the sensor and the load is switched across the load, the stored power derived from the source during that time in which the source drives the load.

In a preferred embodiment, the present invention discloses a two wire sensor which includes switching means setable to one of a high (e.g., open circuit) and a low impedance state (i.e., short circuit) in response to a switching signal for disconnecting/connecting a source of AC power to/from an electrical load. The switching means is interposed within a main conduction path providing power between the AC source and the load. The switching means is connected between a first leg of the AC source and a first terminal of the electrical load. The second terminal of the electrical load is connected to a second leg of the AC source. An energy storage means for storing electrical charge is included which is electrically coupled to the first leg of the AC source and to the first terminal of the electrical load. A charge control means is electrically disposed between the switching means and the energy storage means for regulating the voltage across the energy storage means and therefore the current flowing therein. Circuitry for controlling the switching means is coupled across the energy storage means and responds to detection (or sensing) of the monitored condition by generating the switching signal. The switching signal causes the load to be switched into or out of the powered circuit. The charge stored in the energy storage means drives the switching means.

DETAILED DESCRIPTION OF THE INVENTION

Figure 1:
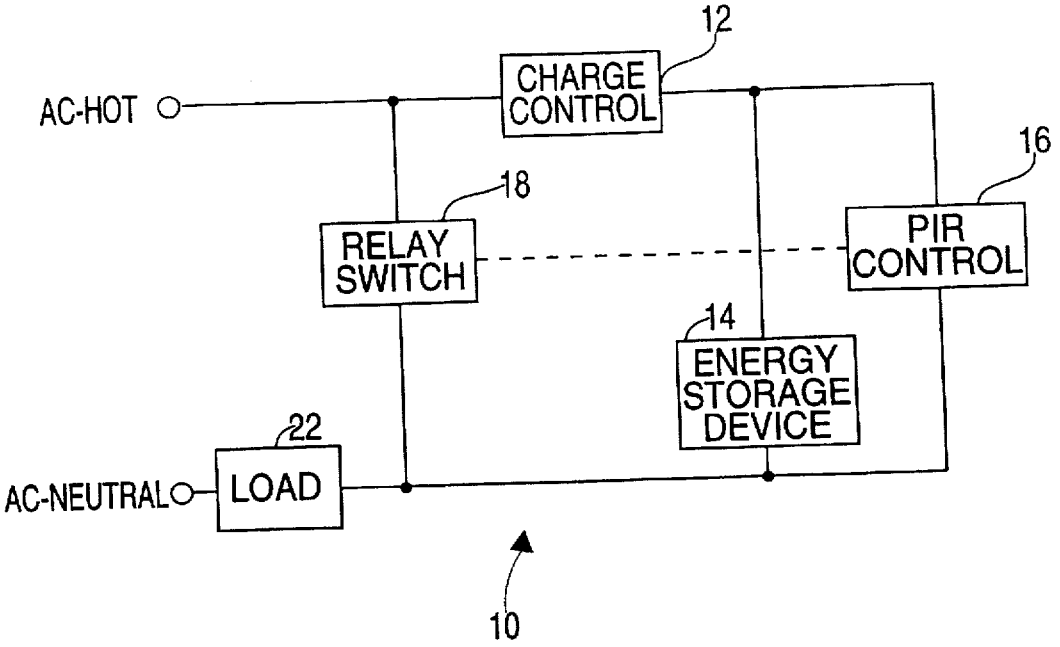
FIG. 1 is a functional block diagram of an embodiment of the invention showing functional blocks and their interconnection.

Shown in FIG. 1 is one embodiment of a two-wire sensor circuit 10 of the present invention (hereinafter referred to simply as the "circuit"). The circuit 10 includes a first terminal for electrical connection to a first leg of an AC power source (AC_HOT), and a second terminal for electrical connection to a first end of an electrical load 22. A second end of the load 22 is electrically connectable to a second leg of the AC source (AC_NEUTRAL). A switching device 18, e.g., a relay switch, is electrically connected between the first and second terminals of the circuit 10. The state of the switching device therefore is defined by circuit operation to control power supplied to the load. The device may be set to either of two states, conducting or non-conducting, referred to interchangeably herein as "on" or "off" and "low impedance" or "high impedance" states, corresponding to closed or open contact states of a relay switch. Switching device 18 is a conventional latching type switch, thus consuming pulse power only during switching periods and consuming no power at all during other times.

A sensor circuit 16, e.g., a PIR control circuit, is electrically coupled to switching means 18, i.e., coupled between the first leg of the AC source and the first end of load 22. The sensor circuit identifies a state of a condition being monitored and defines a state of the switching signal in accordance thereto. The sensor is preferably a passive infrared (PIR) control sensor for providing an occupancy sensing function. The sensor comprises conventional circuitry well known to those skilled in the art. The state of the switching means is defined by the sensor in accordance with an amount of infrared energy detected from an object.

When the contact in switching means 18 is defined by the sensor as open, (i.e., a non-conductive state), substantially no power is delivered to the load. A majority of the AC source voltage appears across the circuit 10 while the switching means 18 is non-conductive because it comprises a relatively high impedance relative to the load 22. Current is therefore provided both to an energy storage device 14 and the sensor circuit 16 through a charge control device 12. Charge control device 12 is electrically disposed between the switching means and the parallel combination of an energy storage device 14 and controller 16.

While the switching means 18 of circuit 10 is in a conductive state, i.e., the contact is closed, substantially all power is delivered to the load. Power required to drive the PIR control (sensor) circuit 16 during this time is provided via energy storage device 14, e.g., to de-energize the load. In addition to providing current to power the sensor (PIR control) circuit 16, the charge control circuit 12 comprises conventional circuitry, well known to those skilled in the art, to limit, filter and control the voltage across the energy storage device 14 and current fed to it. The energy storage device 14 may consist of a conventional rechargeable battery such as nickel cadmium (NiCd), nickel metal hydride (NiMH), lithium or alkaline. Alternatively, a double layer capacitor may be used. Suitable capacitors are Maxcap double layer capacitors manufactured by Cesiwid, Inc. of Niagara Falls, N.Y., or Supercap electric double layer capacitors, manufactured by NEC-Corporation of America. These double layer capacitors typically have capacities on the order of a few farads.

A circuit 10 of this invention which uses a rechargeable battery or a capacitor having a value on the order of a few farads is practical when taken in light of the following example. Typically, circuit 10 is used for occupancy sensing whereby sensor control circuitry 16 embodies a PIR control circuit and switching means 18 embodies a latch relay. PIR control circuits utilizing latch relays consume approximately 0.25 to 1 ma. Lithium coin battery cells, typically, have capacities of 50 to 500 ma-hrs (milliamp hours). A 200 ma-hr lithium battery cell, therefore, could maintain power to a 1 ma PIR control circuit for greater than one week while the PIR detector is subject to constant movement.

Figure 2:
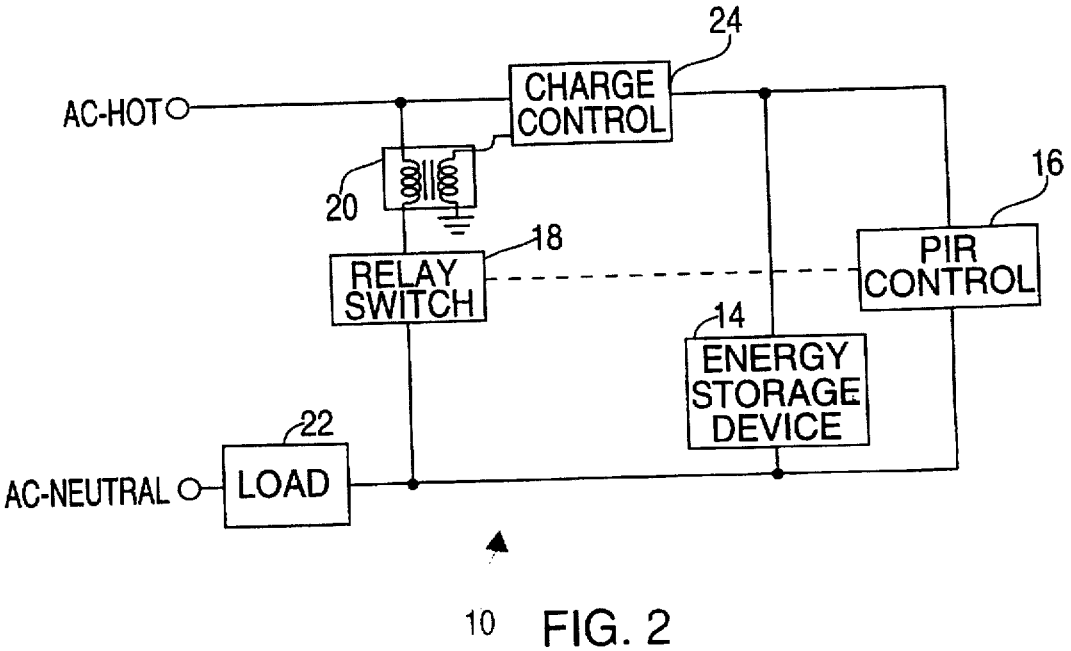
FIG. 2 is a functional block diagram of the preferred embodiment of the invention shown functional blocks and their interconnection.

For indeterminate time periods in which the electrical load 22 must remain energized, a second embodiment of this invention is described with reference to FIG. 2. The figure shows a circuit 10' similar to circuit 1O described above, but includes a conventional current transformer 20 for charging the energy storage device 14 when the load is active, i.e., when the switching means is conductive. It also includes a modified charge control circuit 24 to handle the additional source of voltage (i.e., the current transformer 20) other than the AC power source directly. Modified charge control circuit 24 accepts as inputs both the AC power source directly (i.e., AC_HOT) and a first end of the secondary of the current transformer 20, a second end of which is connected to control circuit DC ground.

The primary winding of the current transformer 20 is connected between the AC-HOT terminal of the AC power source and switching means (i.e., the relay switch) 18. While PIR control circuit 16 defines the state of the switching means (via the switching signal) to prevent a flow of power to the load, i.e., a relay contact of switching means 18 is open, no current flows through the primary winding of the current transformer 20. Accordingly, the PIR control circuit 16 is powered through the charge control circuit 24 from the AC power source. When the circuit 10 defines an operational state in which the load is energized, i.e., the relay contact 18 is closed, the secondary of current transformer 20 provides an induced voltage signal via charge control circuit 24 to charge energy storage device 14. The charge control circuit 24 comprises conventional circuitry, well known to those skilled in the art, to limit, filter and control the voltage across the energy storage device 14 and the current flowing through it. The charge control circuit 24 differs from charge control circuit 12 shown of FIG. 1 in that it receives both the AC power source directly and power output from the secondary of the current transformer 20.

The embodiments of the invention disclosed in the present specification, drawings and claims are presented merely as examples of the invention. Other embodiments, forms, or modifications thereof will readily suggest themselves and are contemplated as coming within the scope of the present invention, which is defined by the following claims.

What is claimed is:

1. A two-wire sensor device, comprising:

a) switching means having a coil and a set of switch contacts, said switch contacts set to their open state or their latched closed state in response to a detector output signal applied to said coil for connecting/disconnecting an AC power source to/from an electrical load, said switch contact connected between a phase conductor of said AC source and a first terminal of said electrical load, wherein a second terminal of said electrical load is connected to a neutral conductor of said AC source;

b) energy storage means electrically coupled at a first end to said phase conductor of said AC source and at a second end to said first terminal of said electrical load;

c) charge control means interposed between said first end of said energy storage means and said phase conductor of said AC source for limiting, filtering and controlling a voltage across said energy storage means; and d) sensor means electrically connected across said energy storage means for sensing a condition being monitored and generating a detector output signal based thereon, said detector output signal being applied to said coil to set the switch contacts in said open state or said latched closed state in accordance with said detector output signal.

2. A two wire sensor device as defined in claim 1, wherein said sensor means is an occupancy detector that produces a first detector output signal if no persons are in the sensor means monitoring area aid said first detector signal is applied to said coil to place said switch contacts in their open state to prevent AC power being applied to said electrical load.

3. A two wire sensor device as defined in claim 2, wherein said sensor means produces a second detector output signal if persons are in the sensor means monitoring area and said second detector signal is applied to said coil to place said switch contacts in their latched closed state to permit AC power being applied to said electrical load.

4. A two wire sensor device as defined in claim 1, wherein each of said energy storage means, said charge control means and said sensor means are high impedance devices.

5. A two wire sensor device as defined in claim 2, wherein said energy storage means provides an operating voltage to said sensor means which said switch contacts are placed in their open state.

6. A two wire sensor device, as defined in claim 2, wherein said energy storage means receives energy to be stored therein when said switch Contacts are placed in their latched closed state.

7. A two wire sensor device, as defined in claim 6, wherein said energy storage means receives energy to be stored therein when said switch contacts are placed in their latched closed state.

8. A two wire sensor device as defined in Claim 1, further comprising:

a) a transformer having a primary winding and a secondary winding;

b) said transformer primary winding connected between said phase conductor of said AC power source aid said switch contacts; and c) said transformer secondary winding connected between said charge control means and ground whereby said energy storage means can receive energy to be stored therein from both said AC power source and said secondary winding of said transformer.

9. A two wire sensor device, as defined in claim in 8, wherein said energy storage means receives energy to be stored therein when said switch contacts are placed in their latched closed state.

10. A two wire sensor device, as defined in claim 8, wherein said energy storage means provides an operating voltage to said sensor means when said switch contacts are placed in their open state.

11. A two wire sensor device, as defined in claim 9, wherein said energy storage means provides an operating voltage to said sensor means when said switch contacts are placed in the open state.

* * * * *